US011759942B2

(12) United States Patent
Hohl et al.

(10) Patent No.: US 11,759,942 B2
(45) Date of Patent: Sep. 19, 2023

(54) BLOCK FOR RECEIVING TOOL ELEMENTS IN A TOOL ARRANGEMENT

(71) Applicant: Würth International AG, Chur (CH)

(72) Inventors: Wolfgang Hohl, Amrichshausen (DE); Johannes Starke, Flein (DE); Marcel Hopf, Crailsheim (DE); Olaf Ritter, Öhringen (DE)

(73) Assignee: Würth International AG, Chur (CH)

( * ) Notice: Subject to any disclaimer, the term of this patent is extended or adjusted under 35 U.S.C. 154(b) by 17 days.

(21) Appl. No.: 17/248,178

(22) Filed: Jan. 12, 2021

(65) Prior Publication Data

US 2021/0245358 A1 Aug. 12, 2021

(30) Foreign Application Priority Data

Feb. 10, 2020 (DE) ..... 102020103316.8

(51) Int. Cl.
*B25H 3/00* (2006.01)

(52) U.S. Cl.
CPC ..... *B25H 3/003* (2013.01)

(58) Field of Classification Search
CPC ... B25H 3/04; B25H 3/23; B25H 3/00; B25H 3/022; B25H 3/003; B25H 3/006; B25H 3/02; B25H 3/023; B25H 3/025; B25H 5/00; B65D 25/107; B65D 58/20; B65D 85/28
USPC ..... 206/379, 372, 373
See application file for complete search history.

(56) References Cited

U.S. PATENT DOCUMENTS 4,776,482 A * 10/1988 Wolters ..... G11B 33/0438 220/531
5,368,164 A 11/1994 Bennett et al.
5,437,502 A * 8/1995 Warnick ..... B25H 3/04 312/249.11
5,464,091 A * 11/1995 Callahan ..... G11B 33/0438
5,827,058 A * 10/1998 Kelly ..... A61C 7/12 206/63.5
6,070,732 A * 6/2000 Chen ..... B25H 3/003 206/751

(Continued)

FOREIGN PATENT DOCUMENTS

CN 1110941 A 11/1995
CN 205034475 U 2/2016

(Continued)

OTHER PUBLICATIONS

First Office Action in Application No. 110104585; pp. 1-20; Sep. 17, 2021; Taiwan Intellectual Property Office; 3F., No. 185, Sec. 2, Xinhai Rd., Da'an Dist., Taipei City 106213, Taiwan (R.O.C.).

(Continued)

*Primary Examiner* — Steven A. Reynolds
*Assistant Examiner* — Prince Pal
(74) *Attorney, Agent, or Firm* — Robert A. Blaha; Smith Tempel Blaha LLC

(57) ABSTRACT

A block for receiving tool elements is provided. The block has an elongated base body and at least one tool element recess which is formed at the base body for user-definedly receiving at least one tool element. The base body further includes coupling structures for detachably coupling the block with a tool management device.

2 Claims, 8 Drawing Sheets

(56) References Cited

U.S. PATENT DOCUMENTS

| | | | | |
|---|---|---|---|---|
| 6,213,296 | B1 * | 4/2001 | Streich | B25H 3/003 206/480 |
| 6,405,864 | B1 * | 6/2002 | Streich | B25H 3/003 206/443 |
| 6,755,302 | B1 * | 6/2004 | Streich | B25H 3/023 206/379 |
| 6,953,114 | B2 * | 10/2005 | Wang | B25H 3/003 206/375 |
| 7,434,688 | B2 * | 10/2008 | Hu | B25H 3/023 206/379 |
| 7,900,771 | B1 * | 3/2011 | Meng | B25H 3/06 206/759 |
| 7,931,143 | B1 * | 4/2011 | Lin | B25H 3/021 220/629 |
| 8,069,984 | B2 * | 12/2011 | Larson | B25H 3/023 206/372 |
| 8,083,060 | B1 * | 12/2011 | Liu | B25H 3/003 211/70.6 |
| 8,196,742 | B1 * | 6/2012 | Wang | B25H 3/003 206/45.23 |
| 8,251,211 | B1 * | 8/2012 | Chen | B25H 3/025 220/811 |
| 8,607,499 | B2 * | 12/2013 | Hoover | A45C 13/02 43/57.1 |
| 9,156,156 | B2 * | 10/2015 | Wang | B25H 3/021 |
| 9,156,157 | B2 * | 10/2015 | Wang | B65D 25/107 |
| 9,254,565 | B1 * | 2/2016 | Wang | B25H 3/02 |
| 9,375,835 | B1 * | 6/2016 | Lin | B25H 3/00 |
| 9,486,912 | B1 * | 11/2016 | Chen | B25H 3/02 |
| 9,625,143 | B2 * | 4/2017 | Hsu | B25H 3/003 |
| 9,656,384 | B1 * | 5/2017 | Tsai | B25H 3/003 |
| 10,220,504 | B2 * | 3/2019 | Brinkhuis | A47F 7/0028 |
| 2003/0010733 | A1 * | 1/2003 | Ling | A47F 7/00 211/70.6 |
| 2003/0080010 | A1 | 5/2003 | Ho | |
| 2004/0188293 | A1 | 9/2004 | Lee | |
| 2005/0211587 | A1 * | 9/2005 | Chen | B25H 3/003 206/349 |
| 2005/0241974 | A1 * | 11/2005 | Chen | B25H 3/003 206/349 |
| 2006/0065557 | A1 * | 3/2006 | Brunson | B25H 3/021 206/273 |
| 2006/0201835 | A1 * | 9/2006 | Shih | B25H 3/023 206/373 |
| 2007/0235360 | A1 * | 10/2007 | Lin | B25H 3/025 206/373 |
| 2007/0257455 | A1 * | 11/2007 | Cho | B25H 3/023 280/47.26 |
| 2011/0031145 | A1 * | 2/2011 | Larson | B25H 3/003 206/372 |
| 2011/0074262 | A1 * | 3/2011 | Liu | B25H 3/028 312/334.1 |
| 2012/0043238 | A1 * | 2/2012 | Christopher | B25H 3/003 206/375 |
| 2013/0284773 | A1 * | 10/2013 | Meng | B25H 3/003 206/349 |
| 2015/0190921 | A1 | 7/2015 | Wang | |
| 2015/0258676 | A1 * | 9/2015 | Wang | B25H 3/021 206/349 |
| 2015/0258677 | A1 * | 9/2015 | Wang | B65D 25/107 206/349 |
| 2016/0052125 | A1 * | 2/2016 | Steele | B65D 25/205 206/349 |
| 2016/0346915 | A1 * | 12/2016 | Lin | B25H 3/02 |
| 2017/0361454 | A1 * | 12/2017 | Hsu | B25H 3/003 |
| 2020/0200340 | A1 * | 6/2020 | Pugh, II | F21V 23/04 |
| 2021/0078159 | A1 * | 3/2021 | Jiang | B65D 21/0213 |
| 2021/0146525 | A1 * | 5/2021 | Spaulding, Jr. | B25H 3/02 |

FOREIGN PATENT DOCUMENTS

| | | | |
|---|---|---|---|
| CN | 208262799 | U | 12/2018 |
| CN | 110248745 | A | 9/2019 |
| DE | 20000943 | U1 | 4/2000 |
| DE | 202009006617 | U1 | 7/2009 |
| DE | 202009011987 | U1 | 12/2009 |
| DE | 202010000452 | U1 | 8/2010 |
| DE | 202013003169 | U1 | 4/2013 |
| DE | 202014104983 | U1 | 11/2014 |
| DE | 202015104503 | U1 | 10/2015 |
| DE | 202017105770 | U1 | 10/2017 |
| DE | 212017000158 | U1 | 2/2019 |
| TW | M560984 | U | 6/2018 |

OTHER PUBLICATIONS

English Translation of First Office Action in Application No. 110104585; pp. 1-16; Sep. 17, 2021; Taiwan Intellectual Property Office; 3F., No. 185, Sec. 2, Xinhai Rd., Da'an Dist., Taipei City 106213, Taiwan (R.O.C.).

Van Woerden, N; Extended European Search Report in Application No. 20213778.2; pp. 1-8; May 11, 2021; European Patent Office, 80298, Munich, Germany.

Search Report in Application No. DE 10 2020 103 316.8; pp. 1-7; Apr. 21, 2022; German Patent and Trademark Office; Zweibrückenstraße 12, 80331, Munich, Germany.

First Office Action in Application No. 110104585; pp. 1-6; Mar. 23, 2023; Taiwan Intellectual Property Office; 3F., No. 185, Sec. 2, Sinhai (Xinhai)RD., Da-an District, Taipei City 106, Taiwan, R. O. C.

English Translation of First Office Action in Application No. 110104585; pp. 1-5; Mar. 23, 2023; Taiwan Intellectual Property Office; 3F., No. 185, Sec. 2, Sinhai (Xinhai)RD., Da-an District, Taipei City 106, Taiwan, R. O. C.

* cited by examiner

BLOCK FOR RECEIVING TOOL ELEMENTS IN A TOOL ARRANGEMENT

CROSS-REFERENCE TO RELATED APPLICATION

The present application claims the benefit of the filing date of German Patent Application No. 10 2020 103 316.8, filed 10 Feb. 2020, the disclosure of which is hereby incorporated herein by reference.

TECHNICAL FIELD

Embodiments of the invention relate to a block for receiving tool elements, a tool arrangement and a method of managing tool elements.

TECHNOLOGICAL BACKGROUND

Bit holders are known in different configurations and application purposes. In particular, small bit boxes in the size of one or two cigarette packets are used, in which multiple bits are arranged and which are closable with a lid. In the bit box, usually an assortment of different bits is arranged.

It is disadvantageous, that the bit boxes are frequently very large, to receive all bit variants. In this case, the stockpiling of the bit box and the carrying of the same to a location of use are problematic. Or the bit boxes are small, which simplifies the stockpiling of the bit variants and the carrying to the location of use. However, in this case, the selection of bits in the bit box is highly limited.

SUMMARY

There may be a need to efficiently organize tool elements.

The subject matters with the features according to the independent patent claims are provided. Further embodiments are shown in the dependent claims.

According to an embodiment of the present invention, a block (in particular an ingot) for receiving tool elements (such as bits and/or drills) is provided, wherein the block comprises an elongated (in particular an ingot-shaped) base body and at least one tool element recess (for example a receiving indentation for a tool element) which is formed at the base body, for user-definedly receiving at least one tool element, and coupling structures which are formed at the base body for detachably coupling the block with a tool management device (for example a box with a lid).

According to a further embodiment of the present invention, a tool arrangement is provided which comprises a block for receiving tool elements with the above-described features and a tool management device with further coupling structures for detachably coupling the tool management device with the coupling structures which are formed at the base body of the block.

According to a still further embodiment of the present invention, a method of managing tool elements is provided, wherein the method comprises user-definedly receiving at least one tool element at at least one tool element recess which is formed at an elongated base body of a block, and coupling the block with a tool management device by forming a detachable operative connection between coupling structures which are formed at the base body and further coupling structures of the tool management device.

OVERVIEW OF EMBODIMENTS

According to an embodiment of the present invention, a block for receiving tool elements is provided, in which one or more user-selectable tool elements can be received in one or more tool element recesses of the block. By means of coupling structures of the block, the block (with or without the tool elements) can be flexibly and reversibly mechanically coupled with a selectable one of different tool management devices with respective corresponding coupling structures. It is also possible to user-specifically combine multiple blocks with one tool management device. In this way, an intuitively handleable, modular and flexible system is provided, by which a user can simply carryably assort required tool elements, a set of tool elements which is desired by the user, by purely selecting and inserting into the respective tool element recess and by detachably coupling the corresponding block with a tool management device. Such a tool arrangement is configurable and reconfigurable as desired by a user and enables to portably bring a compact and lightweight tool arrangement which is tailored to the requirements of the user to a desired location of use.

In the following, additional exemplary embodiments of the block, the tool arrangement and the method are described.

According to an exemplary embodiment, the coupling structures may be arranged at two opposing side surfaces of the base body. In a corresponding manner, the further coupling structures of the tool management device may be arranged at two opposing side surfaces of the tool management device. This enables an especially stable two-sided mounting of the block to the tool management.

According to an exemplary embodiment, the coupling structures may comprise an outer and tapering insertion slant for guidingly inserting a bearing bolt of the tool management device, which insertion slant leads to a locally expanded opening for lockingly receiving the tool management device. Correspondingly, the further coupling structures of the tool management device may comprise a bearing bolt for being guided through an outer and tapering insertion slant of the coupling structures of the block up to a locally expanded opening of the coupling structures of the block, for lockingly receiving the bearing bolt at the block. In a guided manner, a user can thus insert the bearing bolt of the tool management device into the opening of the block, wherein the user is supported or assisted by the insertion aid in form of the insertion slant. Hence, an error-free robust operation of the tool arrangement is ensured.

According to an exemplary embodiment, the further coupling structures may comprise a tapering projection at the bearing bolt, wherein the tapering projection is configured for, in particular form-lockingly, receiving at the tapering insertion slant of the coupling structures of the block. In this way, a simple and guided mounting of the block to the tool management device is combined with a targeted latching, optionally with a haptic feedback to a user.

According to an exemplary embodiment, the coupling structures may comprise an expansion slit which is adjoining the expanded opening at an inner side. Such an expansion slit facilitates the resiliently receiving and attaching of a block to a tool management device, such that the tool arrangement can be effectively protected against a damage during operation.

According to an exemplary embodiment, the block may comprise a run-up slope which is extending along a longitudinal axis of the block body between a top side and a sidewall, preferably slanted with respect to a vertical and to a horizontal vector. Thereby, a user can insert or remove tool elements, such as bits, in a simple manner by hand into or out of the tool element recesses of the block.

According to an exemplary embodiment, the coupling structures may be configured for selectively coupling the block with the tool management device and for selectively decoupling the block from the tool management device, respectively. The possibility to configure the coupling between the block and the tool management device reversibly and detachably, respectively, enables arbitrarily configuring and reconfiguring and equipping and re-equipping, respectively, a block with a user-defined set of tool elements.

According to an exemplary embodiment, the block body may comprise an insertion recess for inserting a tool, in particular a slotted screwdriver, such that, by inserting the tool into the insertion recess, the block can be levered out of the tool management device.

For example, by inserting the slit of a screwdriver into the preferably slit-shaped insertion recess in a front surface and side surface, respectively, of the elongated block by a user, by a proper torque and thus with little force, a block which is mounted with a high attachment force to a tool management device can be dismounted without destruction. Such an insertion recess is an intuitively operable feature for a user, to conveniently and force-savingly release the block from a tool management device.

According to an exemplary embodiment, the block body may comprise a sidewall which comprises the coupling structures, with a hollow which is arranged behind it, such that the sidewall can be engaged behind by an engaging section of the tool management device. In a corresponding manner, the further coupling structures of the tool management device may comprise an engaging section for engaging behind a sidewall of the block, which sidewall comprises the coupling structures. In this way, the block is protected also in its longitudinal direction against an undesired release in a form-locking manner.

According to an exemplary embodiment, at the block body, a serial arrangement of multiple tool element recesses may be formed. For example, at least two, in particular at least four, further in particular at least eight, tool element recesses may be provided in a linear arrangement, to accommodate a corresponding number of tool elements in a space-saving manner in the elongated block.

According to an exemplary embodiment, the at least one tool element recesses may be configured for receiving at least one bit, may in particular comprise a hexagonal inner profile. A "bit" in particular may denote a replaceable screwdriver blade without a handle for a certain screw head profile. A reception body of a bit for inserting into the tool element recess of the block may be shaped hexagonally, for example. The reception body may be inserted into a correspondingly standardized bit holder.

According to an exemplary embodiment, the at least one tool element recess may be configured for receiving at least one bit holder, in particular configured for pivotably receiving at least one bit holder. A "bit holder" in particular may denote a connecting portion between a bit and a driving device (for example a battery-operated screwdriver or manual screwdriver). A bit holder may serve for fixing, by means of the bit, an attachment element, such as a screw.

According to an exemplary embodiment, the at least one tool element recess may be configured for receiving at least one drill, in particular may comprise a circular inner profile. A drill may be configured for use in a drill machine as a tool, by which holes can be generated in a rigid material by a rotating motion. Usually, a drill has a cylindrical reception body which can be inserted in a correspondingly shaped and dimensioned tool element recess. Alternatively or additionally to drills, also other tool elements with cylindrical bodies may be received, in cylindrical tool element recesses, for example milling cutters.

According to an exemplary embodiment, the block may be formed integrally, in particular made of one material, preferably as an injection molded article. In this way, a simple and rapid manufacture of the block with a lightweight configuration is possible.

According to an exemplary embodiment, the at least one tool element recess may be formed in an inner end region, in particular as a half hollow truncated cone, to force an inserted tool element to a pregiven inner position at a shell surface of the tool element recess. According to such an especially advantageous configuration, when inserting a tool element with a cylindrical reception body, the cylindrical reception body, when reaching the half hollow truncated cone, can be laterally pushed against a predefined position of the shell surface of the tool element recess. Thereby, a predefined reception of the tool element in the block is ensured.

According to an exemplary embodiment, the at least one tool element recess may be formed in an outer end region, in particular by a pair of pivoting arms, to force an inserted tool element to a pregiven outer position at a shell surface of the tool element recess. Especially advantageously, at an outer side, preferably two pivoting arms can push a tool element which is received in the tool element recess in a predefined direction and thus can definedly position it.

According to an exemplary embodiment, a connection line between the inner position and the outer position may run in parallel to a central axis of the tool element recess and may run offset to it. In combination, the described shape of the inner end region of the tool element recess and the provision of pivoting arms may cooperate synergistically and may ensure a predefined positioning of the tool element at a desired sidewall of the shell surface. Thereby, undesirably displacing a received tool element can be reliably prevented.

According to an exemplary embodiment, the tool arrangement may comprise at least one further tool management device with further coupling structures for alternatively coupling the at least one further tool management device with the coupling structures which are formed at the base body, alternatively to coupling said tool management device with the block. Descriptively speaking, multiple tool management devices may be provided and may be combined in a user-defined manner in connection with one and the same block and with one and the same set of multiple blocks, respectively. This may be accomplished by configuring the blocks and the tool management device with corresponding coupling structures and by corresponding distances between opposing coupling structures.

According to an exemplary embodiment, at least one of the tool management device and the at least one further tool management device may comprise at least one of a group consisting of a box (in particular with a lid or without lid), one or a plurality (in particular two) coupling belts, a case, a shelf, a tool trolley, and a vehicle. Also, other tool management devices may be combined with one or multiple blocks according to an exemplary embodiment of the invention.

According to an exemplary embodiment, the tool arrangement may comprise at least one further block with the above-described features for receiving tool elements. The coupling structures of the at least one further block may be couplable with the further coupling structures of the tool management device. Not only multiple tool management devices, but also multiple blocks may form a part of a construction set whose constituents can be variably combined by a user to adapt them to a respectively desired set of tool elements.

According to an exemplary embodiment, the further coupling structures may be pivotably arranged at a bottom of the tool management device, to be pivoted for supporting a release of a block which is coupled with the tool management device.

For example, the further coupling structures may be coupled to a bottom of the tool management device by a (preferably integrally formed) hinge at the bottom. By a user pivoting by hand a strip which is connecting, carrying and forming, respectively, the further coupling structures, around a pivoting axis at the bottom of the tool management device, releasing an existing connection between the tool management device and the block may be facilitated and supported, respectively. Descriptively speaking, such a pivotable arrangement of the further coupling structures may therefore serve as a release aid to be able to simply release a fixed connection between the tool management device and the block.

According to an exemplary embodiment, the tool management device may comprise a biasing unit for biasing a coupled block, which biasing unit is configured such that, by merely opening the tool management device, the block is moved at an outer side of the device by means of the biasing unit. Advantageously, the biasing unit may be configured such that, when opening the tool management device, the block is lifted and/or pivoted. For example, a biasing unit may be a spring which is biased by closing a lid of the tool management device while lowering the mounted block. When subsequently opening the lid of the tool management device, the biased spring can relax while lifting the block. In this way, user access to a block which is mounted at the tool management device and to the tool elements which are received at it can be simplified. Alternatively to a spring, also a magnetic mechanism may be utilized as biasing unit, for example. Alternatively to lifting a block when opening a lid of a tool management device, such an opening may lead to pivoting a block which is mounted therein.

According to an exemplary embodiment, the tool management device may be configured as a strip-shaped coupling belt to which the block is coupled. In particular, the tool management device may be configured as a pair of strip-shaped coupling belts between which the block may be coupled. Coupling belts are an especially lightweight and one-dimensionally or two-dimensionally scalable and extendable, respectively, possibility to receive an arbitrary multiplicity of blocks. The blocks which are mounted between two coupling belts may be arranged in parallel with respect to each other in a space-saving manner.

According to an exemplary embodiment, the tool management device may comprise at least one coupling plate which is connectable with a further, in particular identical, coupling plate by corresponding connection structures. "Identical coupling plate" denotes such a one which is identical to said coupling plate with respect to shape and dimensions. A "similar coupling plate" denotes such a one whose shape corresponds to that of said coupling plate, but which may comprise other dimensions, for example. Structures for connecting coupling plates may be formed at similar coupling plates in such a manner, that they can be correspondingly used together. In this way, a modular system may be provided which can be arbitrarily expanded in one or in two dimensions.

According to an exemplary embodiment, the connection structures of a coupling plate may comprise at least one connection pin and/or at least one connection opening. Such a connection pin, due to its shape, may be configured for inserting into the connection opening. Coupling plates with such connection structures may be connected to each other, in order to spatially expand a tool arrangement. For example, it is possible to configure a coupling plate both with connection pins and with connection openings, such that a coupling plate may act both as receiving and as received coupling plate.

According to an exemplary embodiment, the tool management device may be configured as a belt clip. Advantageously, this may be performed such that, when coupling the block with the tool management device, between the belt clip and the block, a loop for guiding a belt through it is formed. According to such a configuration, a user can conveniently carry the tool management device with the block at a belt and can thus, without the need to use his hands, carry it to a location of use. A belt loop may be conveniently formed by placing a block at the tool management device which is configured as belt clip, such that the mounting is simple and convenient for a user.

According to an exemplary embodiment, the tool management device may be configured such that, at a side which is opposite to the loop, at least one further block is couplable. In this way, also in case of a mounting to a belt, a considerable number of tool elements can be carried by a user.

According to an exemplary embodiment, the tool management device may further comprise a plug recess for a bit holder. Separately carrying a bit holder to a location of use may then be dispensable.

According to an exemplary embodiment, the tool management device may be configured as a box, in particular as a box with a lid. In case of a chest and a box, respectively, which preferably can be closed by a lid, the tool elements which are accommodated in the block in the box can be protected against pollution and damage and against undesirably falling out.

According to an exemplary embodiment, the tool management device may comprise at least one groove for suspending the tool management device. In this way, the hands of a user may remain free for performing a mounting task. Alternatively, the groove may also be configured with respect to size and dimension such that it can be gripped by a user.

According to an exemplary embodiment, the tool arrangement may comprise a multiplicity of tool management devices which are connected to each other in a longitudinal direction and/or in a transverse direction. Therefore, tool management devices may be expanded in one or two dimensions, in order to form more complex tool arrangements.

According to an exemplary embodiment, the method may comprise equipping and/or re-equipping the block by a user with a set of user-defined tool elements which is selected from a larger reservoir of tool elements by the user. Thereby, according to embodiments of the invention, a freely combinable modular system is provided.

For example, a block which is configured as a bit block according to an embodiment of the invention may comprise a hexagonal recess for one or more bits. A block which is configured as a drill block may comprise a cylindrical recess and optionally a hollow truncated cone-shaped bottom and pivoting arms. In other words, a tool element recess and the tool elements may be adapted to each other with respect to shape and dimension.

In the following, exemplary embodiments of the present invention are described in detail with reference to the following figures.

DETAILED DESCRIPTION OF EXEMPLARY EMBODIMENTS

Figure 1A:
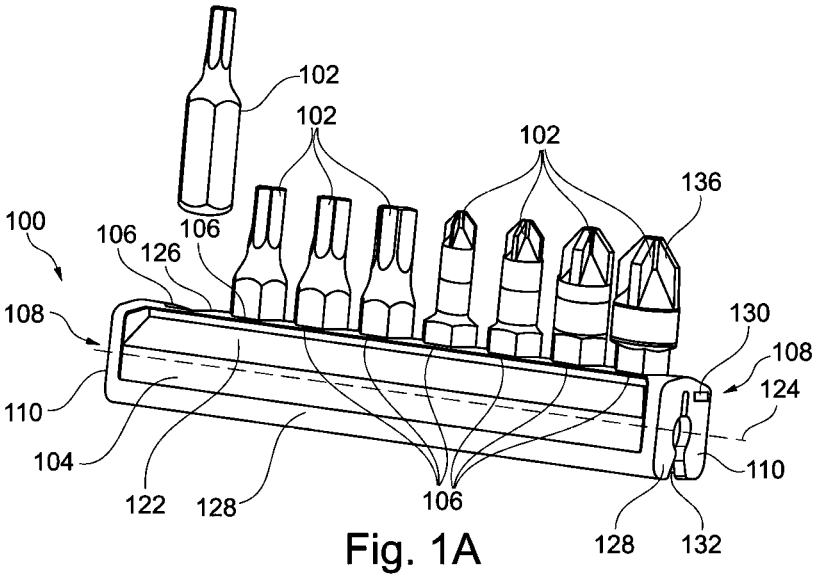
FIG. 1A shows a three-dimensional view of a block which is equipped with bits according to an exemplary embodiment of the invention.

Same or similar components in different figures are provided with the same reference numbers.

Before, referring to the figures, exemplary embodiments of the invention are described, some general aspects of embodiments of the invention shall be explained.

According to an exemplary embodiment of the invention, a block with tool element recess(es) (in particular a bit block as bit receiver) is provided. In this way, a flexibly usable tool arrangement with the tool elements (in particular bits) is provided.

In more detail, a block (in particular a bit block and a drill block, respectively) for receiving a defined number of tool elements (in particular bits and drills, respectively) is provided, which can be individually plugged in the block. According to an embodiment of the invention, this block forms the basis of a storage system for tool elements, such as bits, since the block is insertable in different tool management devices (for example a bit box, a belt box or a drill box) and removable therefrom. In this way, a universally configured and individually equipped block may be available for a user in different application cases, namely in the bit box, at the belt, a machine case, in the drill box, etc. For example, the block can respectively be plugged into the respective tool management device and can be removed therefrom again, preferably by establishing and releasing, respectively, a latching connection.

A block according to an embodiment of the invention generates a basis and forms the basis, respectively, for a system-wide solution of the arrangement and storage and stockpiling, respectively, of bits or other tool elements. For example, a bit block can be removably coupled with a tool management device via a plug reception (compare FIG. 1A and FIG. 1B, for example) and/or a release aid (see FIG. 9B, for example). Therefore, according to an exemplary embodiment of the invention, a block as basis for receiving tool elements, such as bits (by means of a bit block) or drills (for example by means of a drill block) and the like is provided. For example, a bit block may comprise a hexagonal reception for bits. At a drill block, tool element recesses for receiving cylindrical sections of tool elements may be configured. It may be advantageous to equip bottom regions of the tool element recesses with a hollow truncated cone-shaped bottom and/or to equip outer regions of tool element recesses with one or more (preferably with two) pivoting arms. Advantageously, a block according to an exemplary embodiment of the invention may be individually equippable by a user (for example with bits and/or drills, etc.).

A block according to an embodiment may be formed replaceably and may be plugged into a tool management device (such as a bit box, a belt, a case (in particular a machine case), etc.). Such a block can be re-equipped for each application, if necessary. The block may be plugged in a respective tool management device in order to have access to it in a simple manner at a location of use. The bit block or drill block may be respectively equipped from a bit box with a plurality of different bits (for example with different drive types and/or with different drive sizes) for the respective purpose of use. Alternatively, the bit block which is always equipped in the same manner may be carried by a user in different tool management devices for different application purposes (for example in a portable bit box or at the belt, in tool inlays, or in a drill box).

An embodiment of the invention provides a bit block (for example with a hexagonal indentation and a replaceable base portion for a case or another tool management device). Another embodiment provides a drill block (with at least one blind hole and optionally with pivoting arm(s) and optionally with a hollow truncated cone-shaped bottom and a replaceable base portion).

Figure 1B:
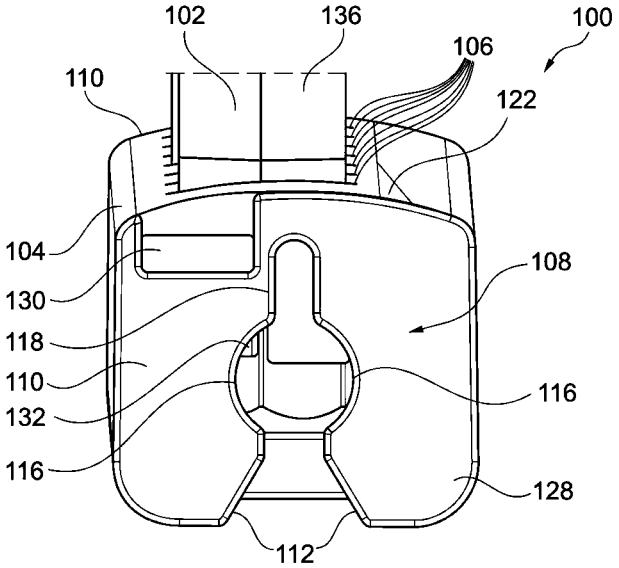
FIG. 1B shows a detail of the block according to FIG. 1A.

FIG. 1A shows a three-dimensional view of a block 100 which is equipped with bits 136, according to an exemplary embodiment of the invention. FIG. 1B shows a detail of the block 100 according to FIG. 1A.

The block 100 which is illustrated in FIG. 1A and FIG. 1B serves for receiving tool elements 102 which are configured as bits 136. The block 100 in turn may be received in a reversible and replaceable manner in an arbitrary one of multiple tool arrangements 120 with corresponding coupling structures 152, for example in the tool arrangements 120 which are shown in FIG. 2A to FIG. 4 and FIG. 6 to FIG. 10.

The block 100 comprises an elongated base body 104 in which a serial arrangement of (in the illustrated embodiment eight) blind hole-shaped tool element recesses 106 is formed. Each tool element recess 106 is configured for receiving a correspondingly shaped tool element 102. For user-definedly receiving at least one tool element 102, a user inserts a tool element 102 in a tool element recess 106 with a corresponding shape and size. In order to be able to receive bits 136 with a hexagonal end, the tool element recesses 106 may be configured as hexagonal blind holes according to FIG. 1A.

As is best shown in FIG. 1B, at the base body 104, coupling structures 108 for coupling the block 100 with a tool management device 140 of the tool arrangement 120 are arranged. The coupling structures 108 according to FIG. 1B are corresponding to the further coupling structures 152 of an assigned tool management device 140, compare FIG. 2B. As schematically shown in FIG. 1A, the coupling structures 108 are preferably arranged at two opposing front surfaces and side surfaces 110, respectively, of the base body 104, i.e., spaced with respect to each other along a longitudinal axis 124. Again referring to FIG. 1B, the coupling structures 108 comprise an outer and inwardly tapering insertion slant 112 for guidingly inserting a bearing bolt 114 which is illustrated in FIG. 2B of the tool management device 140. The inwardly tapering insertion slant 112 at an inner side at first leads to a locally expanded opening 116 with a substantially circular cross-section for lockingly receiving the substantially circular cylinder-shaped bearing bolt 114 of the tool management device 140. Furthermore, the coupling structures 108 advantageously, but optionally, comprise an elongated expansion slit 118 which is adjoining the expanded opening 116 at an inner side in a manner extending in an insertion direction of the bearing bolt 140. Descriptively, the insertion slant 112, the opening 116, and the expansion slit 118 form a complexly shaped hole in an end plate of the base body 104. The coupling structures 108 are formed integrally and with an identical configuration at opposing front surfaces of the base body. The coupling structures 108 serve a user for selectively coupling the block 100 with a desired one of the tool management devices 140 according to FIG. 2A to FIG. 4 and FIG. 6 to FIG. 10, respectively, and for decoupling the block 100 from the desired tool management device 140, respectively. For this purpose, the coupling structures 108 are formed substantially inversely and form-lockingly, respectively, with respect to the further coupling structures 152 of the assigned tool management device 140, compare FIG. 2B.

In more detail, the base body 104 comprises in both opposing end sections a plate-shaped sidewall 128 which is comprising the coupling structures 108 with a hollow 132 arranged behind the sidewall 128. Due to this configuration, the sidewall 128 can be engaged behind by an engaging section 134 which is configured as a vertical strip of the tool management device 140 for forming a firm plug connection.

Moreover, at the same front surface where also the coupling structures 108 are formed, the base body 104 comprises an opening as plug recess 130 for plugging a tool which is not illustrated in the figure, for example a slotted screwdriver. By plugging the tool into the plug recess 130 which is formed as a hole in the sidewall 128 of the base body 104, the block 100 which is mounted and coupled, respectively, at the tool management device 140, can be levered out of the tool management device 140, whereby the corresponding coupling structures 108, 152 are disengaged. In this way, the block 100 can be simply removed from the tool management device 140.

Again referring to FIG. 1A, the block 100 further comprises a run-up slope 122 which extends along the longitudinal axis 124 of the base body 104 between a horizontal top side 126 and a vertical sidewall 128 in an inclined manner. This shape simplifies for a user the manual access to the tool elements 102 in the single recess 106. If required, the run-up slope 122 can also be used as inscription field for inscribing the block 100.

Advantageously, according to FIG. 1A and FIG. 1B, the block 100 may be integrally formed and made of one material and in particular may be manufactured by injection molding. Manufacturing the block 100 can be achieved with a low effort, in a mechanically robust and lightweight manner.

FIG. 1A and FIG. 1B thus show a bit block as example for a block 100 according to an exemplary embodiment. The block 100 according to FIG. 1A and FIG. 1B comprises an elongated extension and eight tool element recesses 106 as plug locations for plugging bits 136. In the illustrated embodiment, the block 100 is consisting of plastic and is integrally manufactured by injection molding. To be able to simply remove a bit 136 from the block 100, at a longitudinal side and along a longitudinal direction 124, respectively, of the block 100, the run-up slope 122 extends almost along the entire elongated extension direction of the block 100. The latter can also be used as label field. At opposing side surfaces of the block 100, respectively the above-described V-shaped insertion slant 112 is formed, which leads to a circular bearing opening 116. The latter in turn leads to the expansion slit 118. This configuration serves for simply and guidingly inserting the bearing bolt 114 of the further coupling structures 152 into the bearing opening 116. In particular, the run-up slope 112 facilitates inserting the bearing bolt 114 into the bearing opening 116. There, the bearing bolt 114 is arranged in a form-locking and preferably latching manner. The expansion slit 118 facilitates the expansion of the side surface for inserting the bearing bolt 114. In the side surface of the base body 104, there is further the plug recess 130 for plugging a slotted screwdriver or the like, to be able to lever the block 100 out of its holder.

Figure 2A:
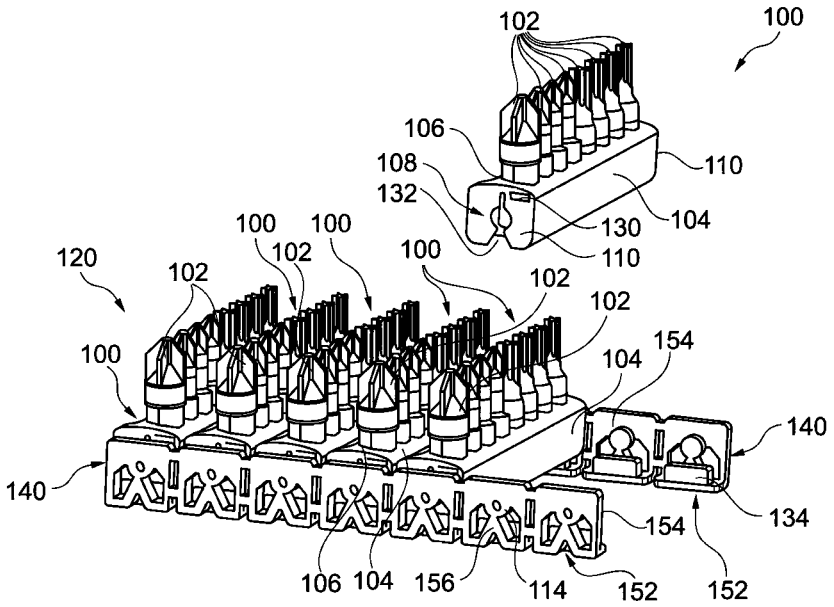
FIG. 2A shows a three-dimensional view of a tool arrangement according to an exemplary embodiment of the invention made of a tool management device which is formed by two coupling belts and multiple blocks which are coupled with it, according to FIG. 1A and FIG. 1B.
Figure 2B:
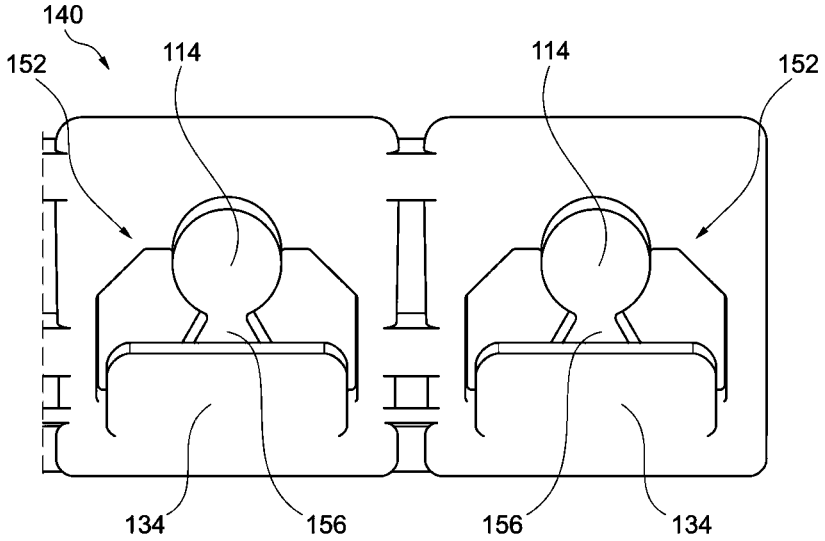
FIG. 2B shows a detail of the tool management device according to FIG. 2A.

FIG. 2A shows a three-dimensional view of a tool arrangement 120 according to an exemplary embodiment of the invention, made of a tool management device 140 which is formed by two coupling belts and multiple blocks 100 according to FIG. 1A and FIG. 1B which are coupled with it and which are arranged in parallel with respect to each other. FIG. 2B shows a detail of the coupling structures 152 of the tool management device 140 according to FIG. 2A.

The tool management device 140 according to FIG. 2A and FIG. 2B is configured to cooperate with the block 100 according to FIG. 1A and FIG. 1B for forming a tool arrangement 120. In particular, this is accomplished by the configuration of the coupling structures 108, 152 which is adapted with respect to each other. For this purpose, the tool management device 140 is formed with further coupling structures 152 for coupling the tool management device 140 with the coupling structures 108 which are formed at the base body 104 of a block 100. As illustrated in FIG. 2A, by means of the tool management device 140, multiple blocks 100 according to FIG. 1A and FIG. 1B which are arranged in parallel with respect to each other can be received at the same time. Each one of these blocks 100 can be individually equipped by a user with desired tool elements 102, to portably transport a user-defined set of tool elements 102 to a location of use.

As illustrated in FIG. 2A and FIG. 2B, the further coupling structures 152 are arranged at two opposing side surfaces 154 of the tool management device 140. In more detail, at each of the coupling belts, a serial arrangement of further coupling structures 152 is provided. Each set of further coupling structures 152 is configured for connecting to the coupling structures 108 of an assigned block 100. This enables a space-saving parallel arrangement of multiple blocks 100 in the manner shown in FIG. 2A using only two coupling belts.

As can best be seen in FIG. 2B, the further coupling structures 152 respectively comprise a bearing bolt 114 for being guided through an outer and tapering insertion slant 112 of the coupling structures 108 of the assigned block 100 up to a locally expanded opening 116 of the coupling structures 108 of the assigned block 100 for lockingly receiving the bearing bolt 114 at the block 100. Moreover, the further coupling structures 152 contain a for example substantially triangular, tapering projection 156 at the bearing bolt 114. The tapering projection 156 is configured for form-lockingly receiving at the tapering insertion slant 112 the coupling structures 108 of the block 100. Furthermore, the further coupling structures 152 have a strip-shaped engaging section 134 in form of a vertical small plate for engaging behind a sidewall 128 of the assigned block 100.

As can best be seen in FIG. 2A, the tool management device 140 in the described embodiment is configured as a pair of coupling belts which are strip-shaped and arranged in parallel with respect to each other, between which the blocks 100 are coupled in the longitudinal direction 124.

For managing the tool elements 102 which are here configured as bits 136, a user can receive a desired set of tool elements 102 at the tool element recesses 106 which are formed at the elongated base body 104 of the respective block 100. Prior or subsequently, the user can mount a block 100 which is equipped by a user with the both coupling belts of the tool management device 140 for forming a form-locking connection between the coupling structures 108 which are formed at the base body 104 and the further coupling structures 152 of the tool management device 140. Therefore, the illustrated tool arrangement 120 enables equipping and/or re-equipping of each block 100 by a user with a set of user-defined tool elements 102 which can be selected by a user from a larger reservoir of tool elements 102. In a corresponding manner, a user can select a desired set of blocks 100, in order to combine it with a desired tool management device 140 (for example that one illustrated in FIG. 2A or one or more of the ones illustrated in FIG. 3, FIG. 4 and FIG. 6 to FIG. 10, respectively).

FIG. 2A and FIG. 2B show an embodiment with an especially simple holder and storage of blocks 100, respectively. A substantially strip-shaped coupling belt comprises, corresponding to the V-shaped insertion slant 112 and the bearing opening 116 of the side surface 128 of the respective block 100, a V-shaped holding section in form of the substantially triangular projection 156, and the bearing bolt 114. These further coupling structures 152 are respectively formed congruently with respect to their counterpart of the coupling structures 108. Rectangular engaging sections 134 are offset to the inside for engaging behind a respective sidewall 128 of the inserted block 100. According to FIG. 2A and FIG. 2B, the coupling belts are used in pairs and are arranged opposing to each other with a distance of the length of the longest side of a respective block 100. After plugging the blocks 100, the coupling belts comprise the proper distance with respect to each other, and further blocks 100 can be plugged in. The coupling belts can also be configured such that multiple coupling belts are connectable to each other in the longitudinal direction, i.e., in the horizontal direction according to FIG. 2A and FIG. 2B. The engaging sections 134, the bearing bolt 114 and the projection 156 of the coupling belts may be formed at both sides of the coupling belts.

Figure 3:
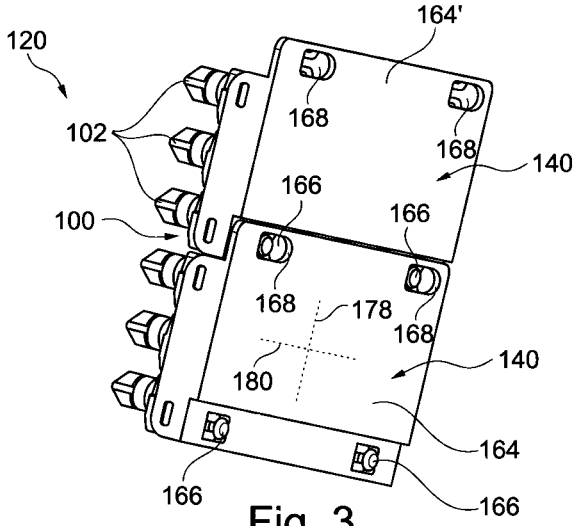
FIG. 3 shows a three-dimensional bottom view of a tool arrangement made of a tool management device which comprises two connected coupling plates and blocks which are coupled with the tool management device, according to another exemplary embodiment of the invention.

FIG. 3 shows a three-dimensional view of a tool arrangement 120 made of a tool management device 140, which is formed by two connected coupling plates 164, 164', and blocks 100 according to another exemplary embodiment of the invention, which are coupled thereto.

Thus, the tool arrangement 120 according to FIG. 3 shows another tool management device 140 with further coupling structures 152 for, with respect to FIG. 2A and FIG. 2B, alternatively coupling with the coupling structures 108 which are formed at the base body 104 of the block 100 according to FIG. 1A and FIG. 1B. In other words, a block 100 according to FIG. 1A and FIG. 1B can be used with completely different tool management devices 140, for example that one according to FIG. 2A and FIG. 2B or that one according to FIG. 3. Hence, the system of blocks 100 and tool management devices 140 according to exemplary embodiments of the invention is completely modular.

According to FIG. 3, the illustrated tool management device 140 comprises two coupling plates 164, 164' which are coupled to each other. As shown in FIG. 3, the coupling plate 164 is detachably connected to the identical further coupling plate 164' by means of corresponding connection structures 166, 168. The connection structures 166, 168 of a respective coupling plate 164, 164' comprise connection pins 166 and connection openings 168. A connection pin 166 of one of the coupling plates 164, 164' may be coupled and engaged, respectively, in a form-locking and detachable manner with a connection opening 168 of the respectively other coupling plates 164', 164 by forming a plug connection. By connecting the coupling plates 164, 164' in the longitudinal direction 168 and/or in the transverse direction 180, tool management devices 140 which are connected to each other and substantially freely scalable can be formed.

FIG. 3 also shows coupling plates 164, 164' in which the receiving structures and coupling structures 152, respectively, are formed which are described with reference to FIG. 2A and FIG. 2B, for cooperating with corresponding coupling structures 108 of a respective block 100. According to FIG. 3, a respective coupling plate 164, 164' comprises a bottom and three sidewalls. At the bottom, respectively two connection pins 166 and two connection openings 168 are formed, in order to connect multiple coupling plates 164, 164' with each other—as shown in FIG. 3, for example. The connection openings 168 may also be used to suspend a coupling plate 164, 164' to a wall, to a tool trolley or the like (not shown).

Figure 4:
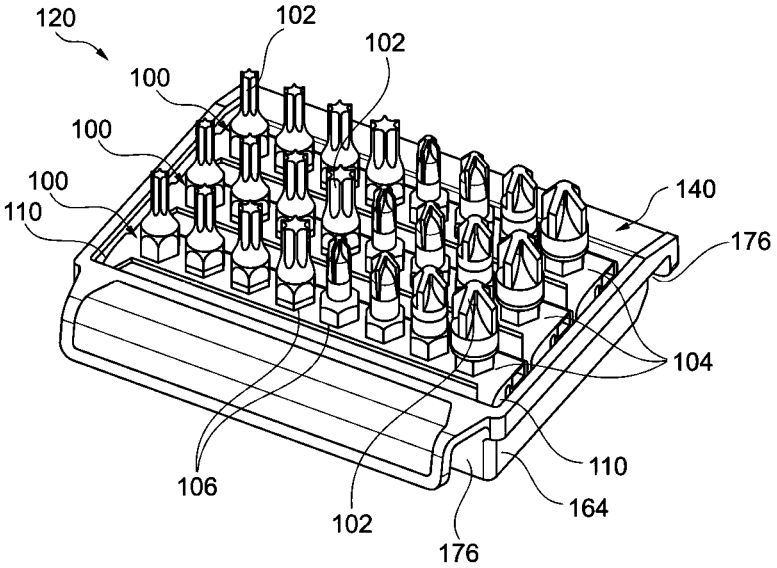
FIG. 4 shows a three-dimensional view of a tool arrangement made of a tool management device which comprises a coupling plate and blocks which are coupled with the tool management device, according to another exemplary embodiment of the invention.

FIG. 4 shows a three-dimensional view of a tool arrangement 120 made of a tool management device 140 which comprises a coupling plate 164, and blocks 100 which are coupled with it, according to another exemplary embodiment of the invention.

According to FIG. 4, the tool management device 140 comprises two opposing grooves 176 for suspending or handling the tool management device 140. FIG. 4 shows a coupling plate 164 which is alternative to FIG. 3, which comprises a bottom and four sidewalls. At the opposing longitudinal sides, as an elongation of the respective sidewall, elongated wall sections are formed, which are drawn downwardly under formation of a respective groove 176. These grooves 176 may be used for suspending the coupling plate 164 to a tool trolley or a rail or the like (not shown).

Figure 5:
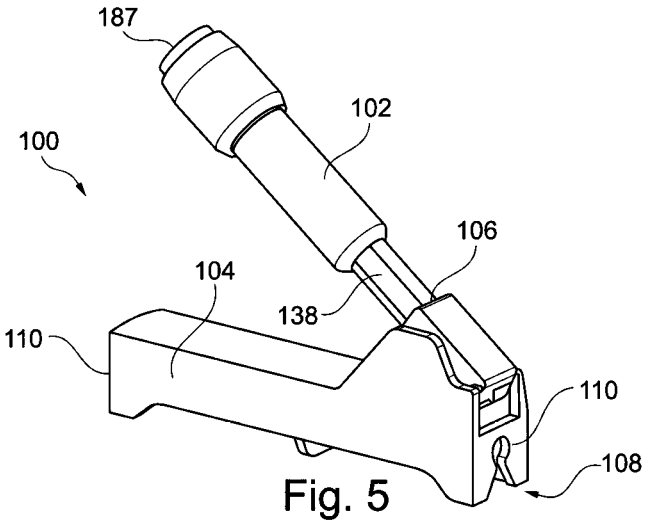
FIG. 5 shows a three-dimensional view of a block which is equipped with a bit holder, according to another exemplary embodiment of the invention.

FIG. 5 shows a three-dimensional view of a block 100 which is equipped with a bit holder 138 according to another exemplary embodiment of the invention. The tool element recess 106 which is shown in FIG. 5 is configured for receiving the bit holder 138. In more detail, the tool element recess 106 according to FIG. 5 serves for pivotably receiving the bit holder 138. The bit holder 138 in turn serves for receiving a bit 136 at a bit-receiving unit 187.

Thus, FIG. 5 shows a block 100 which is however not configured for receiving bits 136, but for holding a bit holder 138 which is pivotably mounted at the block 100. Besides, the dimensions and the connection structures correspond to that of the previously described bit beam and block 100, respectively.

Figure 6:
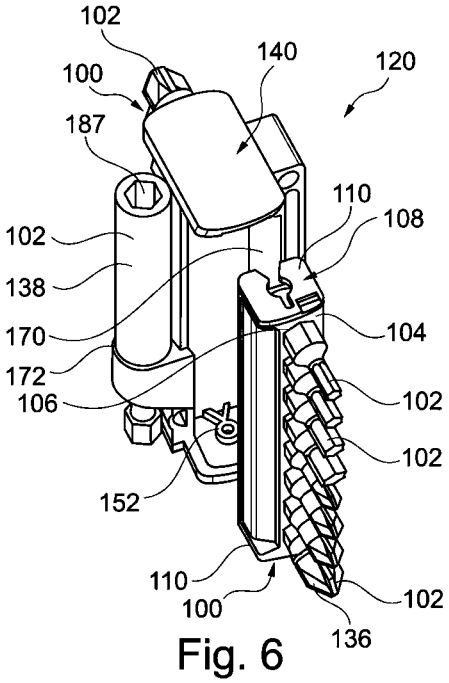
FIG. 6 shows a three-dimensional view of a tool arrangement made of a tool management device which is attachable to a belt and blocks which are coupled with the belt, according to still another exemplary embodiment of the invention.

FIG. 6 shows a three-dimensional view of a tool arrangement 120 made of a tool management device 140 which is attachable to a belt (not shown) and blocks 100 according to a still further exemplary embodiment of the invention which are coupled with it.

Hence, according to FIG. 6, the tool management device 140 is configured as a belt clip. When coupling the block 100 which is illustrated in the front of FIG. 6 with the tool management device 140, between the belt clip and the block 100, a loop 170 for guiding a belt (not shown) through it may thus be formed. Furthermore, the tool management device 140 according to FIG. 6 is configured such that, to a side which is opposing the loop 170, at least one further block 100 is couplable. As shown in FIG. 6, the illustrated tool management device 140 further comprises a plug recess 172 for a bit holder 138.

Thus, FIG. 6 shows a belt clip with a backside in which the loop 170 for guiding a belt through it is formed. At the opposing front side, a bit holder 138 is pluggably arranged. At the opposing sidewalls, the described receiving structures and coupling structures 152, respectively, for the block 100 which is configured as a bit block are formed, as they are described in similar form for example with reference to FIG. 2A and FIG. 2B. Thus, in each sidewall of the tool management device 140 according to FIG. 6, respectively one block 100 is pluggable. Alternatively, also plugging only one block 100 to the tool management device 140 may be enabled.

Figure 7:
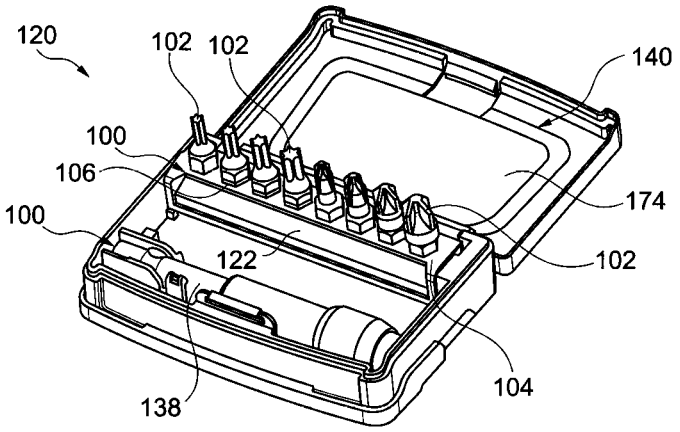
FIG. 7 shows a three-dimensional view of a tool arrangement made of a tool management device which is configured as a box and blocks which are coupled with the box, according to another exemplary embodiment of the invention.

FIG. 7 shows a three-dimensional view of a tool arrangement 120 made of a tool management device 140 which is configured as a box with a lid 174, and blocks 100 which are coupled with it, according to another exemplary embodiment of the invention.

FIG. 7 shows a bit box in which two receiving structures and coupling structures 152, respectively, for respectively one block 100 are formed. In the bit box, a block 100 with eight bits 136 and a block 100 with a bit holder 138 are arranged. A block 100 of the bit box is positioned uprightly, since it is pivoted by a biasing unit which is configured as a spring (not shown) in the shown orientation which runs perpendicularly with respect to the bottom, when the lid 174 of the bit box is opened.

Figure 8A:
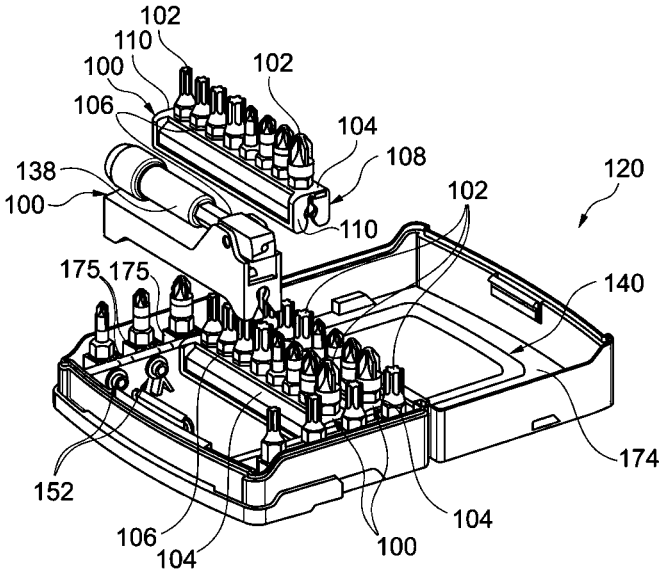
FIG. 8A and FIG. 8B show three-dimensional views of a tool arrangement made of a tool management device which is configured as a box and blocks which are coupled with the box, according to another exemplary embodiment of the invention.
Figure 8B:
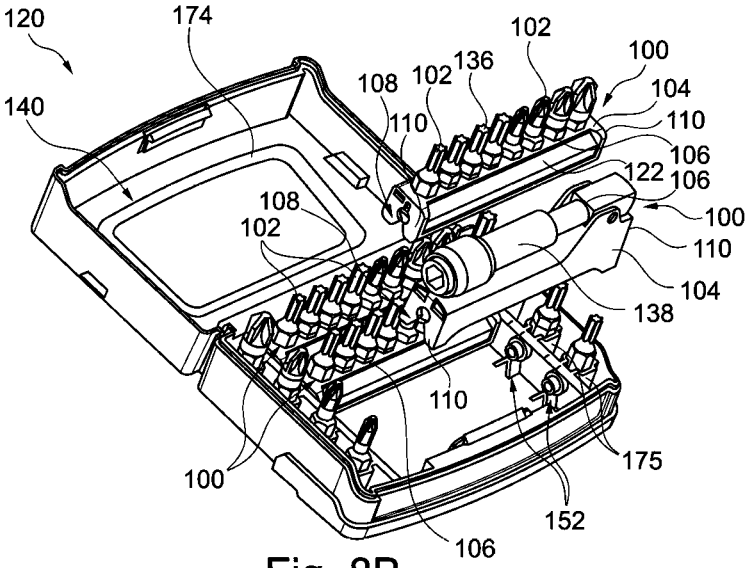

FIG. 8A and FIG. 8B show three-dimensional views of a tool arrangement 120 made of a tool management device 140 which is configured as a box, and blocks 100 which are coupled with it, according to another exemplary embodiment of the invention.

FIG. 8A and FIG. 8B show a larger bit box in which receiving structures and coupling structures 152, respectively, for four blocks 100 are formed, for example. Four bit beams and blocks 100, respectively, may be arranged in the transverse direction of the bit box. At the short side of the box according to FIG. 8A and FIG. 8B, fixed receiving structures 175 for bits 136 are provided, for example at each side for four bits 136.

Figure 9A:
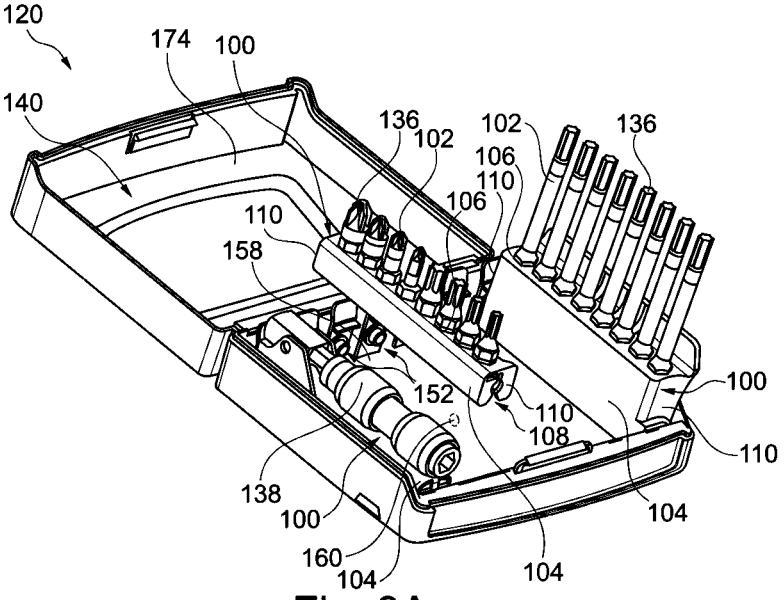
FIG. 9A and FIG. 9B show three-dimensional views of a tool arrangement made of a tool management device which is configured as a box and blocks which are coupled with the box, according to still another exemplary embodiment of the invention.
Figure 9B:
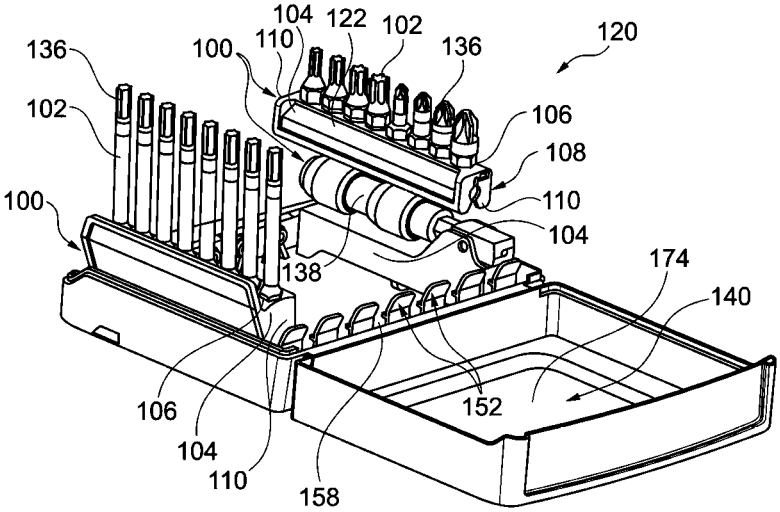

FIG. 9A and FIG. 9B show three-dimensional views of a tool arrangement 120 made of a tool management device 140 which is configured as a box, and blocks 100 which are coupled with it, according to a still further exemplary embodiment of the invention.

According to this embodiment, the further coupling structures 152 are pivotably mounted to a bottom 158 of the tool management device 140, to be pivoted for supporting a release of a block 100 which is coupled with the tool management device 140. Furthermore, according to FIG. 9A and FIG. 9B, the tool management device 140 comprises a schematically illustrated biasing unit 160 for biasing a coupled block 100. The biasing unit 160 may be configured such that, when opening the lid 174 of the tool management device 140, the block 100 is moved by means of the biasing unit 160 to an outer side of the device, i.e., upwardly in the shown embodiment. More generally, the biasing unit 160 may be configured such that, when opening the tool management device 140, the block 100 is automatically and self-actingly, respectively, lifted and/or pivoted.

FIG. 9A and FIG. 9B show a bit box in which receiving structures and coupling structures 152 for multiple blocks 100 are formed. In a first block 100, a bit holder 138 is arranged, in the adjacent block 100, eight bits 136 are arranged, for example. At the opposing end, a block 100 is arranged, in which longer bits 136 are arranged. This block 100 comprises the described coupling structure in the sidewalls, wherein the coupling structure nevertheless additionally comprises a release aid. With the aid of the release aid, the coupling structure can be pivoted in the direction of the sidewall of the bit box, to pivot away the coupling structure from the block 100, to thereby facilitate the removal of the block 100. However, the block 100 comprises a central portion which is pivotable with respect to the sidewall, in which central portion the long bits 136 are plugged, such that these can be pivoted to the bottom of the bit box.

The release aid according to FIG. 9A and FIG. 9B may pivot a respective coupling structure 152 in the direction of a sidewall, to at least partially release a block 100 at this side from the coupling and to facilitate the release of the block 100. For example, the coupling structures 152 may be provided as fixed coupling structures at a sidewall. When such coupling structures 152 are pivotably or tiltably attached to the bottom of the tool management device 140, the connection of a block 100 releases completely or partially, when a user pivots or actuates a respective one of the coupling structures 152. For example, the connection of the pivotable coupling structures 152 may be formed by a mechanical weakness at a corresponding position of an injection molded body or as injection molded integral hinge. Such a release aid may enable the pivoting of the coupling structures 152 in the direction of the sidewall, for being enabled to remove an assigned block 100 in a simpler manner.

Furthermore, in the embodiment according to FIG. 9A and FIG. 9B, an erection aid may be implemented. For example, by means of the erection aid, a block 100 may be erected when the lid 174 opens.

Figure 10:
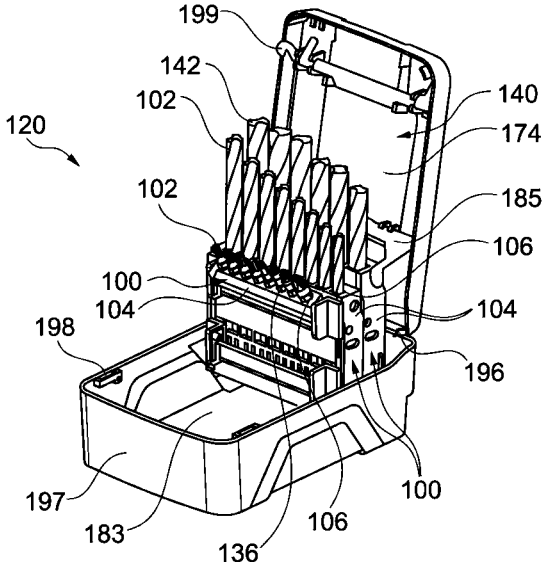
FIG. 10 shows a three-dimensional view of a tool arrangement made of a tool management device which is configured as a box and blocks which are coupled with the box, which are equipped with bits and drills, according to still another exemplary embodiment of the invention.

FIG. 10 shows a three-dimensional view of a tool arrangement 120 made of a tool management device 140 which is configured as a box with a pivotable lid 174, and blocks 100 which are coupled with it, which blocks are equipped with bits 136 and drills 142, according to a still further exemplary embodiment of the invention.

A corresponding tool element recess 106 of a respective drill-block 100 may be configured for receiving a drill 142 with a cylindrical end portion and may comprise a circular inner profile for this purpose.

Thus, FIG. 10 shows a drill box, in which multiple drills 142 are arranged. At the holding portion and block 100, respectively, for the drills 142, coupling structures 108 for a pivotable reception at the tool management device 140 are arranged. Furthermore, in another block 100, bits 136 (for example long or short bits) or a bit holder 138 or the like may be carried.

In FIG. 10, a closing-opening-mechanism 198, 199 is illustrated, by which the lid 174 can be selectively closed or opened with respect to a bottom 197 of the illustrated tool management device 140. Pivoting the lid 174 with respect to the bottom 197 may be realized by a hinge connection 196, for example.

Furthermore, one of the blocks 100 is pivotably mounted in the tool management device 140. This is the block 100 which is pivotably coupled via a further hinge connection 185 with the lid 174. The other blocks 100 which are illustrated in FIG. 10 are rigidly attached to said pivotably mounted block 100. When the lid 174 is pivoted with respect to the bottom 197 by the hinge connection 196, the further hinge connection 195 causes a co-pivoting of the pivotably mounted block 100 out of a receiving room 183 of the tool management device 140 to the erected orientation which is illustrated in FIG. 10. The further blocks 100 which are rigidly attached to the pivotably mounted block 100 follow this pivoting motion.

Figure 11:
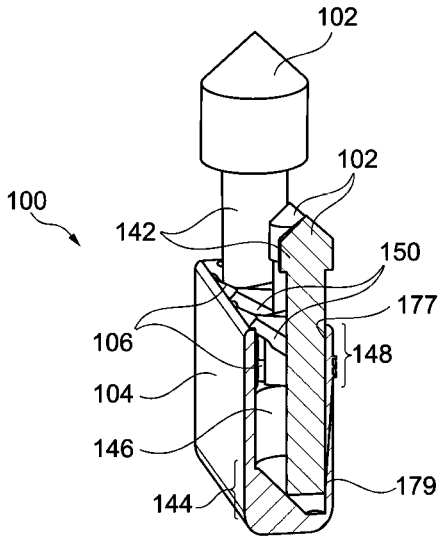
FIG. 11 and FIG. 12 show three-dimensional views of a block which is equipped with drills or other tools, according to still another exemplary embodiment of the invention.
Figure 12:
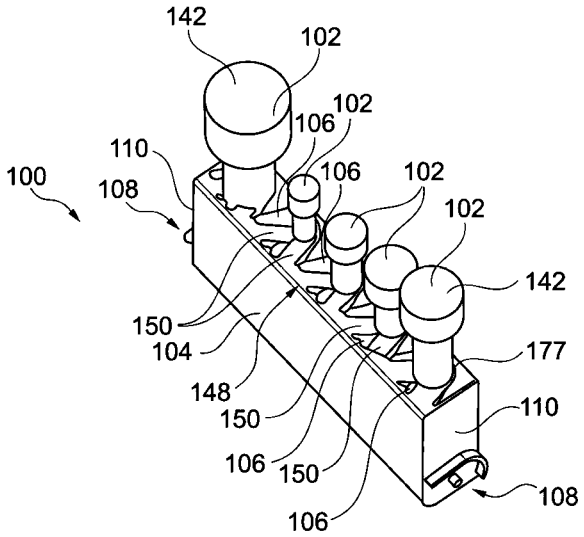

FIG. 11 and FIG. 12 show three-dimensional views of a block 100 which is equipped with drills 142 or the like, according to an exemplary embodiment of the invention.

As illustrated in FIG. 11, the tool element recesses 106 in an inner end region 144 may be configured as a half hollow truncated cone, to force an inserted tool element 102 to a pregiven inner position 179 at a shell surface 146 of the tool element recess 106. As illustrated in FIG. 12, the tool element recesses 106 may be provided with a pair of pivoting arms 150 in an outer end region 148, to force an inserted tool element 102 to a pregiven outer position 177 at the shell surface 146 of the tool element recess 106. Advantageously, a connection line, which is approximately vertical according to FIG. 11, between the inner position 179 and the outer position 177 may run in parallel and be axially offset with respect to a central axis of the tool element recess 106.

FIG. 11 shows a cross-section and FIG. 12 shows a perspective view of a further embodiment of the invention with two further features which can be realized independently from each other, which, in cooperation with each other, provide a block 100 for drills 142, milling cutters, countersinks etc. with variable and different, respectively, shaft diameter(s). The first feature can be seen in FIG. 11: the bottom of each blind hole of the block 100 is formed by semicircular hollow truncated cone. The hollow truncated cone is semicircular in the plan view, and the longitudinal axis and radius axis, respectively, of the hollow truncated cone is on the shell surface 146 of the blind hole bore. When a drill 142 is inserted into the blind hole, it is therefore pressed at the bottom against the shell surface 146 of the blind hole bore. The second feature can be seen in FIG. 12: accordingly, two pivotably mounted pivoting arms 150 are provided which are elastically pivotable in the blind hole bore. When a drill 142 is inserted in the blind hole, the pivoting arms 150 push the drill 142 at an upper end of the blind hole bore against the shell surface 146 of the blind hole bore. Both features together therefore cause that an inserted drill 142, both at a lower end of the blind hole bore (by the hollow truncated cone) and at the upper end of the blind hole bore (by the pivoting arms 150), is pushed against the shell surface 146 of the blind hole drill, which leads to an especially proper hold of the drill 142 in the blind hole bore. It is advantageous that the pivoting arms 150 and the hollow truncated cone push the shaft of the drill 142 to the same position of the shell surface 146 (in particular to the same axially running line on the shell surface 146), such that no tilting of the drill 142 in the blind hole occurs.

It should be noted that "comprising" does not exclude other elements or steps and the article "a" or "an" does not exclude a plurality. Furthermore, it is noted that features or steps, which are described with reference to one of the above embodiments, can also be used in combination with other features or steps of other examples described above.

The invention claimed is:

1. A method of managing tool elements, comprising:

user-definedly receiving at least one tool element at at least one tool element recess which is formed in an elongated base body of a block; and coupling the block with a tool management device by forming a detachable operative connection between an outer and tapering insertion slant formed at the base body and leading to a locally expanded opening formed at the base body and a bearing bolt formed at the tool management device;

wherein the bearing bolt of the tool management device is guidingly inserted in the outer and tapering insertion slant of the base body, wherein the bearing bolt of the tool management device is lockingly received in the locally expanded opening of the base body;

the base body of the block further comprises an expansion slit adjoining the locally expanded opening at an inner side and being arranged at a side of the locally expanded opening opposite to the outer and tapering insertion slant, wherein the expansion slit facilitates resiliently receiving and attaching of the block to the tool management device, such that the block is protected against a damage during operation.

2. The method according to claim 1, wherein the method comprises equipping and/or re-equipping the block by a user with a set of user defined tool elements which is selected from a larger reservoir of tool elements by a user.

* * * * *